United States Patent [19]

Russo et al.

[11] Patent Number: 4,475,322

[45] Date of Patent: Oct. 9, 1984

[54] MEDICAL SEE-THROUGH COLUMNS

[75] Inventors: Joseph L. Russo; Richard Sonder, both of New York, N.Y.; Wesley W. Schwartz, Oshkosh, Wis.

[73] Assignee: Square D Company, Palatine, Ill.

[21] Appl. No.: 221,875

[22] Filed: Dec. 31, 1980

[51] Int. Cl.[3] ..... E04F 19/00

[52] U.S. Cl. ..... 52/27; 312/209; 312/223

[58] Field of Search ..... 52/27, 173 R; 174/48, 174/49; 362/85; 128/1 R; 312/209, 223

[56] References Cited

U.S. PATENT DOCUMENTS

| | | | |
|---|---|---|---|
| 2,334,776 | 11/1943 | King et al. | 312/209 X |
| 3,032,057 | 5/1962 | Mays | 128/207.19 X |
| 3,462,892 | 8/1969 | Meyer | 52/173 P |
| 3,660,591 | 5/1972 | Schultz et al. | 52/173 X |
| 3,762,398 | 10/1973 | Schefke et al. | 128/630 |
| 3,769,502 | 10/1973 | Schultz et al. | 362/228 X |
| 3,920,299 | 11/1975 | Propst et al. | 312/223 |
| 3,921,345 | 11/1975 | Damico | 174/49 P |
| 4,053,193 | 10/1977 | Grover et al. | 312/209 |
| 4,338,485 | 7/1982 | Fullenkamp et al. | 174/48 |

FOREIGN PATENT DOCUMENTS

| | | | |
|---|---|---|---|
| 1236145 | 3/1967 | Fed. Rep. of Germany | 312/209 |

*Primary Examiner*—Carl D. Friedman

*Attorney, Agent, or Firm*—Stephen A. Litchfield; John R. Garrett; Donald P. Reynolds

[57] ABSTRACT

A medical power service column for use in a hospital room for supplying electrical power, lighting and gases and also for providing a centralized support for medical equipment. The medical column comprises a lower column section having an upper end and a lower end in contact with the floor of the hospital room, a see-through section having a first end attached to the upper end of the lower column section for providing increased visibility in the hospital room and a second end extending upward toward the ceiling of the hospital room, and an upper column section attached to the second end of the see-through section for supplying room lighting for the hospital room.

15 Claims, 17 Drawing Figures

MEDICAL SEE-THROUGH COLUMNS

CROSS-REFERENCE TO RELATED APPLICATIONS

This application relates to, but is no way dependent upon copending application of common ownership Ser. No. 221,871 filed Dec. 31, 1980.

BACKGROUND OF THE INVENTION AND PRIOR ART STATEMENT

This invention relates in general to medical power service columns for use in hospital rooms and in particular to a medical column having a see-through feature. Conventionally, medical walls and columns are structures which house electrical, medical and gas equipment for use in hospital rooms, especially intensive care rooms and coronary care rooms. These structures are usually prefabricated in portions or totally at a manufacturing plant and are then installed in hospital rooms and connected to electrical power distribution systems, patient monitoring systems and gas supplies in the ceiling, walls or floors of the room. Although medical columns have been used in the past, medical walls are more common. The following patents illustrate some of the prior art.

U.S. Pat. Nos. 3,769,502 and 3,660,591 disclose medical walls currently in use in hospitals. The medical wall disclosed has a head wall portion and two wedge shaped sections which project from the opposite vertical edges of the wall section. The medical wall contains various electrical and gas outlets and other medical and electrical equipment. The medical wall disclosed as best shown in FIG. 1 of U.S. Pat. No. 3,769,502 and U.S. Pat. No. 3,660,591 is permanently attached to the wall and has the disadvantage that, because of the wings or side sections, hospital personnel are hampered in getting to the patient without moving the bed out away from the medical wall. Although the wall may be suitable for normal hospital rooms, in intensive care and coronary care rooms where the beds are not positioned necessarily against the wall, they would have little or no use. Column 1, lines 35 to 67 and Column 2, lines 1 to 50 of U.S. Pat. No. 3,769,502 and Column 1, lines 26 to 75 and Column 2, lines 1 to 28 of U.S. Pat. No. 3,660,591 set forth the pertinent features and summary of the invention of the disclosed medical walls.

U.S. Pat. No. 3,462,892 discloses a typical manner of construction for medical walls. The structure generally comprises a pair of horizontal members and a plurality of vertical members interconnecting the horizontal members. Spaced apart channel members are supplied for supporting various medical and electrical equipment and outlets. FIG. 5 and lines 20 to 63 of Column 2 in U.S. Pat. No. 3,462,892 best illustrate the type of construction disclosed. The construction disclosed although adequate for medical walls would not be sufficient or practical for medical columns. Since the column is positioned away from the wall in the hospital room the type of construction would need to be substantially stronger and would require more than covering both sides of the frame work with face panels. Such a medical column formed from a medical wall would be lacking in structural strength without extensive redesign.

U.S. Pat. No. 3,762,398 discloses a medical column which is movable in the room and which may also be positioned against a wall of the room. The disclosed medical column is best shown in FIG. 4 and described in Column 5, lines 3 to 17. As can be seen from the drawing, the medical column is large and requires a substantial amount of space in the hospital room. This is a disadvantage in that most hospital rooms do not have a sufficient amount of space for a medical column of this size. Also a severe disadvantage is the fact that the medical column must be connected by electrical and gas lines to the wall of the room thereby preventing anyone from walking totally around the medical column as may be necessary in emergency situations.

U.S. Pat. No. 3,032,057 discloses another medical column for use in an operating room which is attached only to the ceiling and may be pulled down when in use, or pushed back up toward the ceiling when not in use. The disclosed medical column is best described in Column 2, lines 53 to 73 and Column 3, lines 1 to 10. The disadvantage of the column is that, although it may be pushed up towards the ceiling, a typical hospital room has an 8' ceiling and there would not be sufficient clearance for a person to walk under the column. In addition, if the column were bumped into in either the extended position or in the non-extended position there is a danger of disturbing medical equipment mounted on the column or of perhaps actually loosening the column from its attachment at the ceiling. Another disadvantage of the column is that it also obscures visibility of the hospital room.

OBJECTS OF THE INVENTION

It is a general object of the present invention to provide an improved medical power service column for use in a hospital room.

It is a more specific object of the present invention to provide a medical power service column which does not substantially impair visibility in the hospital room.

It is another object of the present invention to provide a medical power service column which allows substantially free access to the patient in bed located in the hospital room.

It is a further object to provide a more versatile medical power service column.

It is another object to provide a medical power service column which is easier and cheaper to manufacture.

DESCRIPTION OF THE PREFERRED EMBODIMENT

Figure 1:
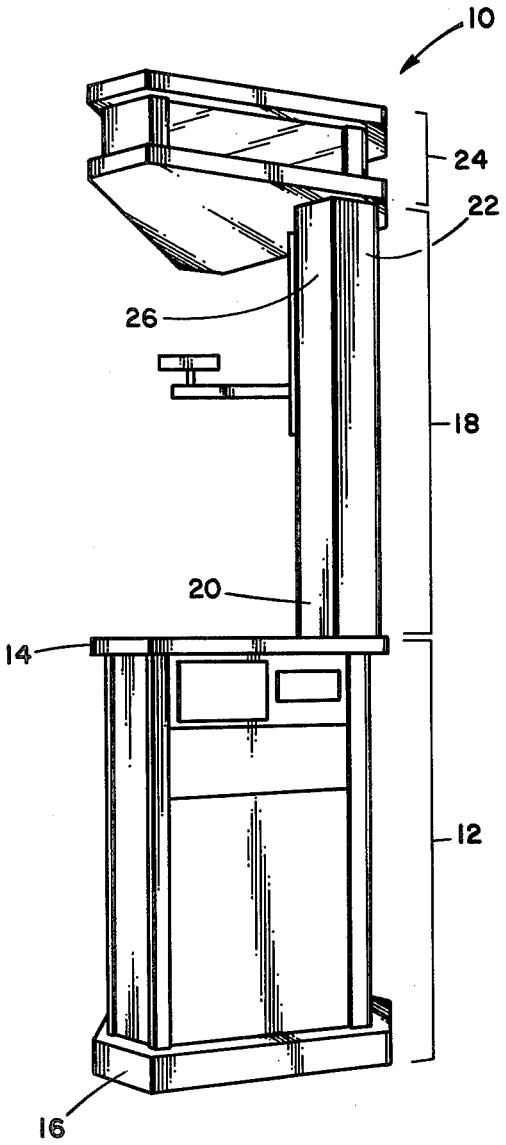
FIGS. 1 and 2 are perspective views of the novel medical power service column.
Figure 2:
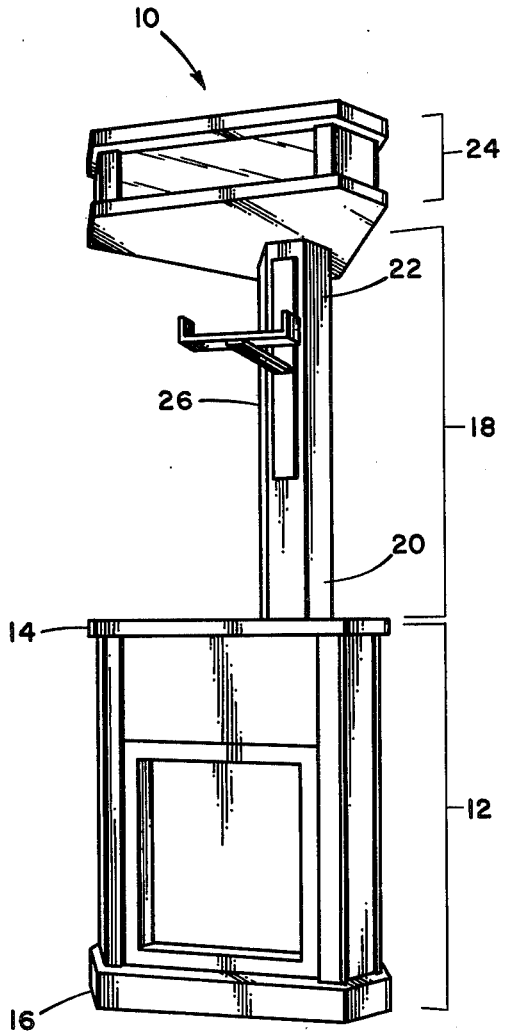
Figure 3:
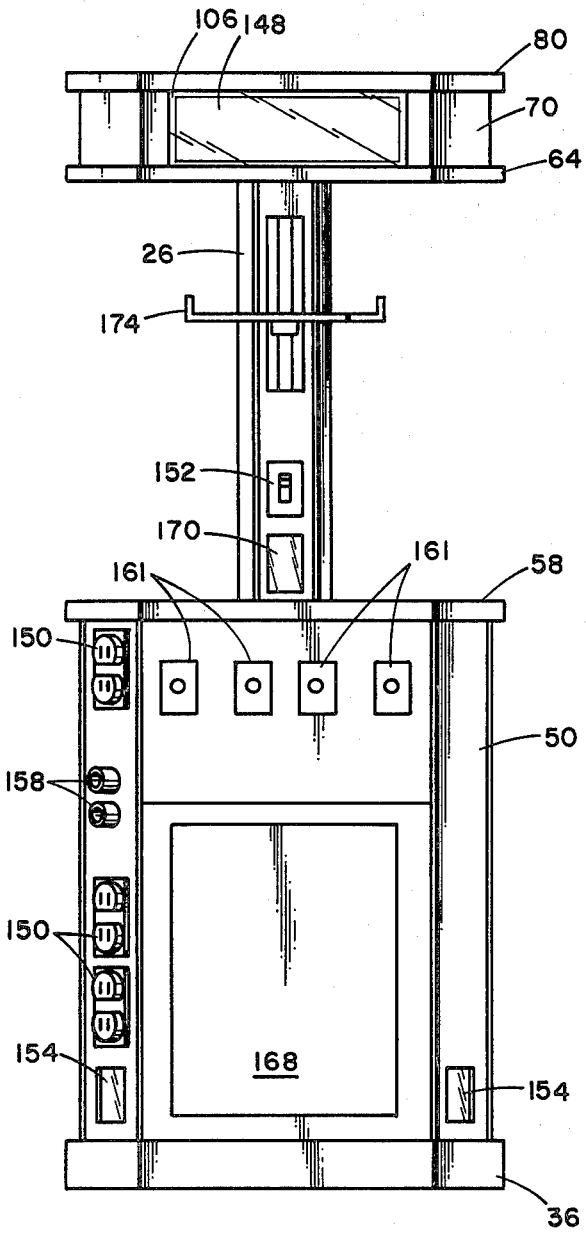
FIGS. 3 to 6 are different side views of the medical column.
Figure 4:
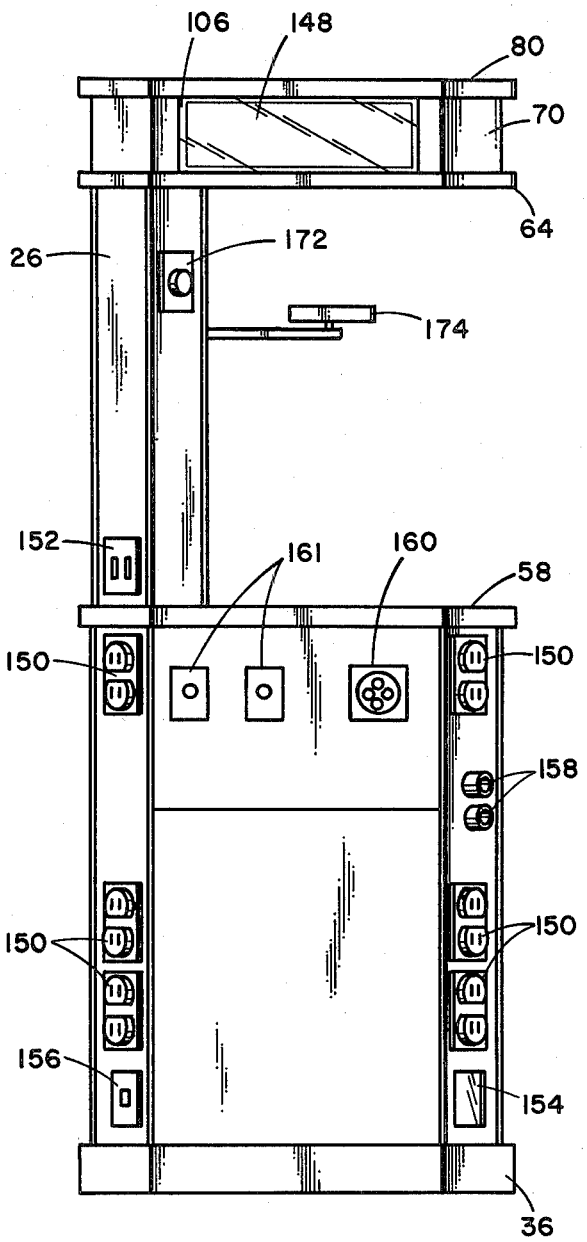
Figure 5:
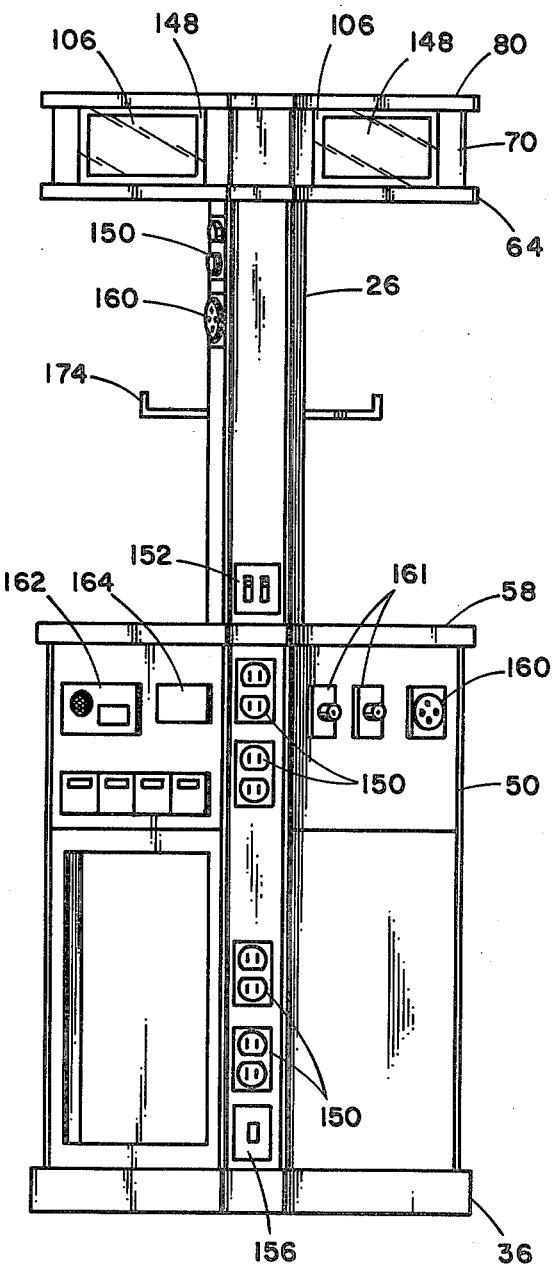
Figure 6:
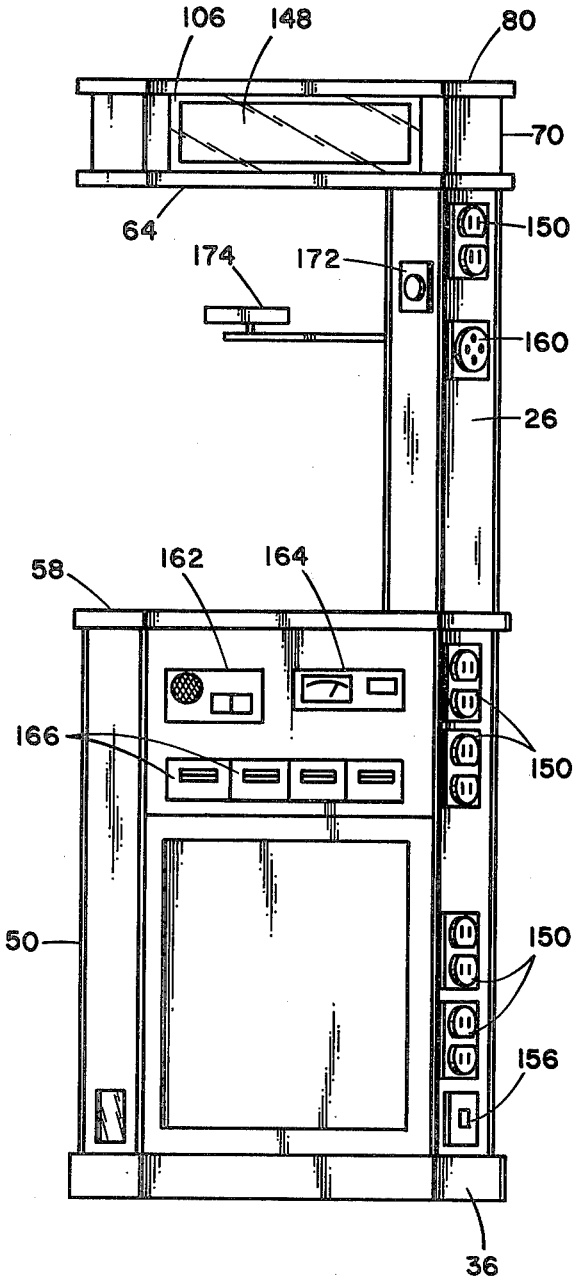

Whereas the invention may be implemented in various types of medical power service columns, it is preferably embodied in a column of the nature shown in FIGS. 1 and 2. The medical power service column is especially useful in hospital rooms designated for intensive care and for coronary care. The medical column allows personnel to move freely in the room and to have a substantially unobscured view of the room. In addition, the novel shape of the medical column allows free access to the patient in the bed as will be described later. The medical column is extremely versatile in the positioning of electrical and medical equipment and electrical and gas outlets on the column. Also, the novel medical column may be prefabricated in a manufacturing plant and shipped in sections or intact to the hospital where it can be used in new construction or in remodeling.

The novel medical power service column 10 is for use in a hospital room having a floor and ceiling and sources of electricity and gases. The medical column 10 supplies electrical power, lighting and gases and also provides a centralized support for medical equipment. In general, the medical column 10 comprises a lower column section 12 having an upper end 14 and a lower end 16 in contact with the floor of the hospital room. The lower column section 12 contains electrical equipment with electrical outlets, gas outlets, electrical switches and means for supporting medical equipment on its outer surface. A see-through section 18 has a first end 20 attached to the upper end 14 of the lower column section 12. The see-through section 18 provides increased visibility in the hospital room. The see-through section 18 has a second end 22 extending upward toward the ceiling of the hospital room. The see-through section 18 has provisions for supporting medical and electrical equipment. The medical column 10 also comprises an upper column section 24 attached to the second end 22 of the see-through section 18.

In the preferred embodiment the medical power service column 10 extends completely between the floor and the ceiling of the hospital room. For fitting hospital rooms of various ceiling heights several see-through sections 18 can be fabricated of various lengths. However, it is envisioned that it would not be necessary for the upper column section 24 to extend entirely to the ceiling. Although in the preferred embodiment the medical column 10 is attached both to the floor and ceiling of the hospital room the construction of the medical column 10 is such that only attachment to the floor may be utilized allowing a "free standing" version of the medical column 10.

In the embodiment shown in FIGS. 1 and 2, the see-through section 18 comprises at least one post 26 for supporting medical and electrical equipment. Although the post 26 could be positioned anywhere between the lower and upper column sections 12 and 24, in the preferred embodiment the post 26 is positioned off-center with respect to the lower column section 12. The lower column section 12 is substantially greater in height than the upper column section 24. The see-through section 18 is an important feature of the present invention and provides a substantially unobscured view of the hospital room for personnel in the room.

Figure 10:
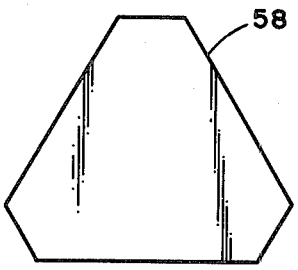
Figure 14:
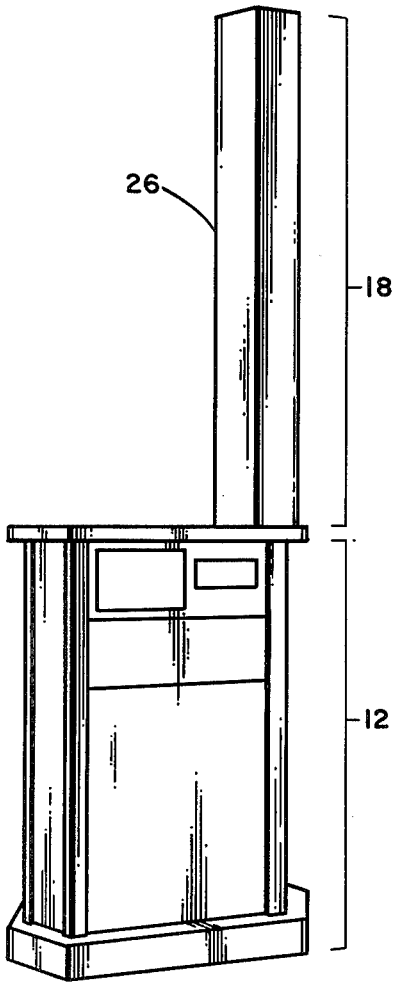
FIGS. 14 to 16 are perspective views of alternative embodiments of the medical power service column.

The medical power service column 10 will now be described in more detail. It is to be understood that in the following description the upper column section 24 may be omitted, thereby resulting in an alternative embodiment as shown in FIG. 14. The preferred embodiment as shown in FIGS. 1 and 2 will now be described in detail. The medical power service column 10 has a flat-cornered triangular cross-sectional shape as best shown by the portion of the medical column illustrated in FIG. 10, and which will be described in greater detail later. However, the shape shown in FIG. 10 is applicable to the overall novel shape of the medical column 10 and illustrates the configuration which has been given the term "flat-cornered triangular shape".

The flat-cornered triangular shape is another feature of the present invention. By positioning the medical column such that one of the corners of the column is next to the patient's bed, hospital personnel are not hampered in administering to the patient. The novel medical column allows free access to the patient while supporting medical equipment in closed proximity to the patient. The novel flat-corners of the medical column allow efficient use of space on the column and are designed to house electrical or gas outlet boxes.

Referring now to FIGS. 3 to 7, the medical column 10 is for use in a hospital room having a floor 28 and a ceiling 30. The hospital room has sources of electricity 32 and gases 34. These are shown schematically in FIG. 7 and it should be understood that there would be more than one electrical line and more than one gas line running to the medical column 10. Also it should be understood that the electrical lines would be both high voltage and low voltage lines. The medical column 10 comprises a base 36 having a flat-cornered triangular cross-sectional shape and also has means 38 for attaching the base 36 to the floor 28 of the hospital room. In the preferred embodiment, the means 38 for attaching the base 36 comprises a jack screw 40 threaded into a bracket 42 for making minor adjustments in the height and leveling of the medical column 10. Angle brackets 44 are bolted to the floor 28 with bolts 46 to prevent sideways movement of the medical column 10. Preferably, three means 38 would be utilized and would be positioned on the base 36 near each of the corners of the base 36. Once the medical column 10 has been positioned, any gap which may occur between the base 36 and the floor 28 can be concealed with conventional cove molding 48 which can be attached to the base 36.

The medical column 10 further comprises a lower wall enclosure 50 having an upper end 52 and a lower end 54 attached to the base 36. The lower wall enclosure 50 has a flat-cornered triangular cross-sectional shape of slightly less dimension than the base 36. However, the base 36 could be made smaller than the lower wall enclosure 50 to provide a "toe space" if desired. The lower wall enclosure 50 contains electrical equipment 56 and electrical and gas supply lines 60 and 62 schematically shown in FIG. 7 and supports various electrical and medical devices such as electrical and gas outlets and means for holding medical equipment on its outer surface. A more detailed listing of these devices will be given later. A top cover 58 is provided and is attached to the upper end 52 of the lower wall enclosure 50 and covers the upper end 52. The top cover also has a flat-cornered triangular shape as shown in FIG. 10.

Figure 7:
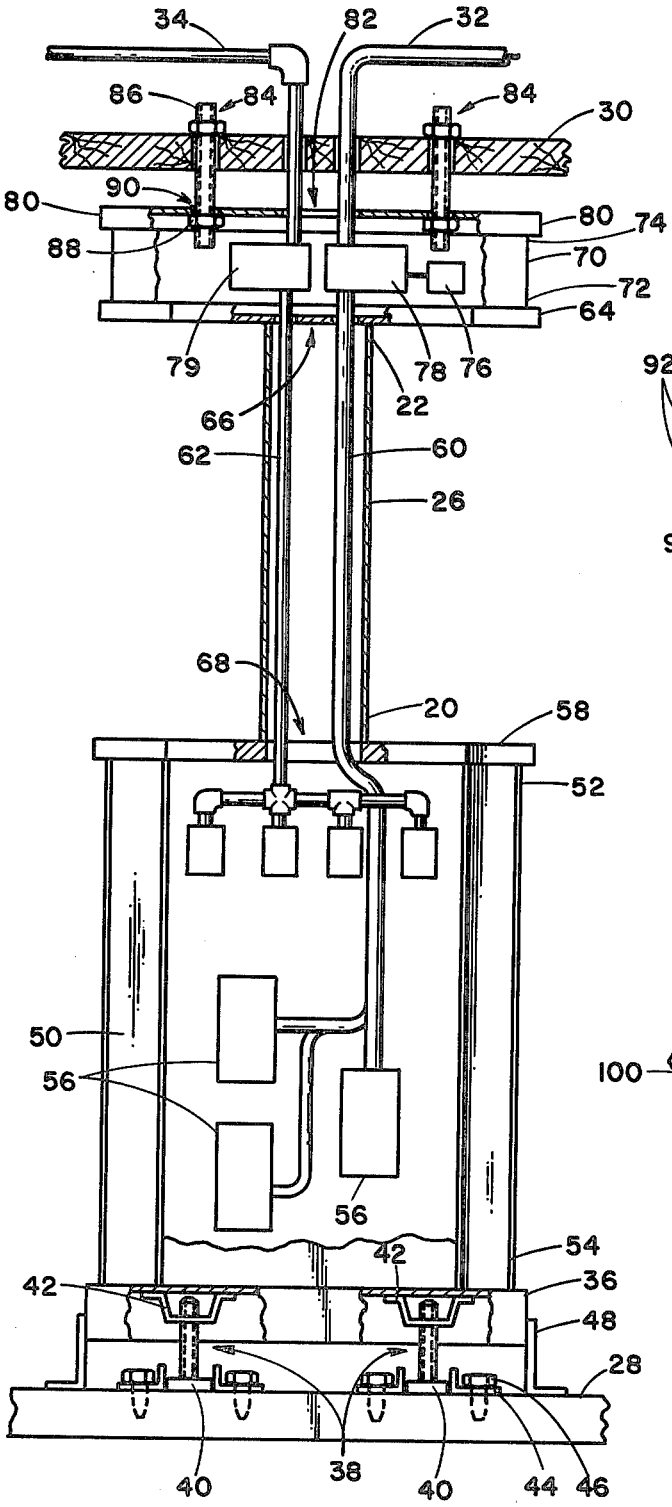
FIG. 7 is a schematic representation of the medical column showing attachment and placement of electrical and gas supply lines and also the means of attachment of the medical column to the floor and/or ceiling of the hospital room.

The medical column 10 also comprises a see-through section 18 having a reduced dimension relative to the lower wall enclosure 50 and extends upward from the upper end 14 of the lower column section 12. The see-through section 18 comprises a six-sided post 26. The first end 20 of the see-through section 18 or post 26 is attached to the top cover 58. As shown in FIG. 7, both the lower wall enclosure 50 and the post 26 contain electrical and gas lines 60 and 62. The post 26 also has electrical outlets, switches, lights and means for holding medical equipment on its outer surface. A bottom cover 64 having a flat-cornered triangular shape corresponding to the top cover 58 is attached to the second end 22 of the see-through section 18 or post 26. The bottom cover 64 has an aperture 66 through which the electrical and gas lines 60 and 62 may pass. Correspondently, the top cover 58 has an aperture 68 through which the electrical and gas lines 60 and 62 may pass.

The medical column 10 further comprises an upper wall enclosure 70 having a lower end 72 attached to the bottom cover 64 and an upper end 74. The upper wall enclosure 70 has a flat-cornered triangular cross-sectional shape similar to the shape of the lower wall enclosure 50. The upper wall enclosure 70 also contains electrical and gas lines 60 and 62 and other electrical devices 76. In addition the upper wall enclosure 70 has provisions 78 and 79 for attaching the electrical and gas lines 60 and 62 to the electrical and gas supplies 32 and 34 in the ceiling of the hospital room.

The medical column 10 also comprises a roof cover 80 in close proximity to the ceiling 30 of the hospital room. The roof cover 80 also has a flat-cornered triangular shape corresponding to the bottom cover 64 and top cover 58. The roof cover 80 is attached to the upper end 74 of the upper wall enclosure 70 and has an aperture 82 for receiving the sources 32 and 34 of electricity and gases. The roof cover 80 further has means 84 for attaching the medical column 10 to the ceiling 30 of the hospital room. The means 84 comprises a threaded rod 86 embedded in the ceiling 30 to which is attached a nut 88. The threaded rod 86 passes through holes 90 located in the roof cover 80. In the preferred embodiment three means 84 are used for attaching the roof cover 80 and are positioned near each corner of the roof cover 80. For rooms having suspended ceilings longer rods would be used to attach the roof cover 80 to the building structure above the suspended ceiling.

Figure 8:
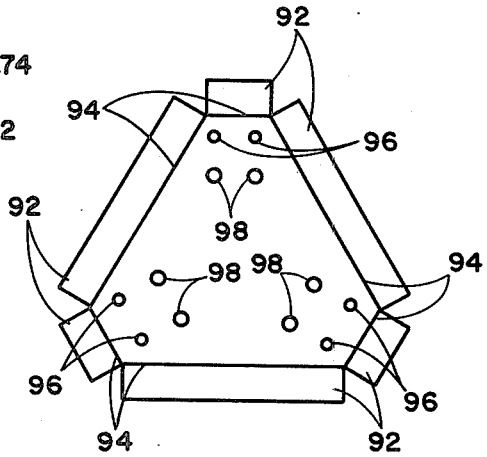
FIGS. 8 to 11 are top views of various sections of the novel medical power service column.

The details of construction of the medical column 10 will now be discussed. The base 36 of the medical column 10 may be formed from a single flat sheet of steel by cutting from the sheet of steel a configuration as shown in FIG. 8. The peripheral tabs 92 are folded down along line 94 and the opened seams are welded shut. Holes 96 are provided for securing the lower wall enclosure 50 and holes 98 are provided for securing the means 38 for attaching the base 36 to the floor 28 of the hospital room. The welded seams are finished and the base is appropriately painted to complete the assembly.

Figure 9:
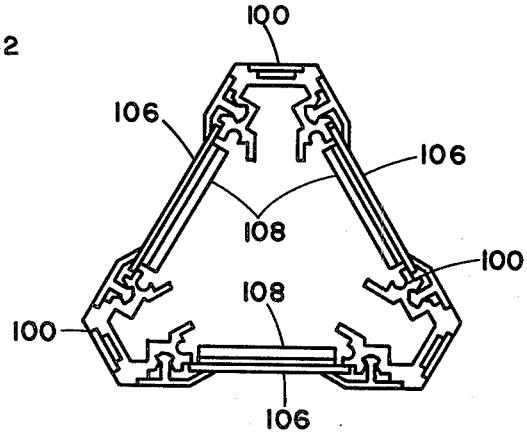
Figure 12:
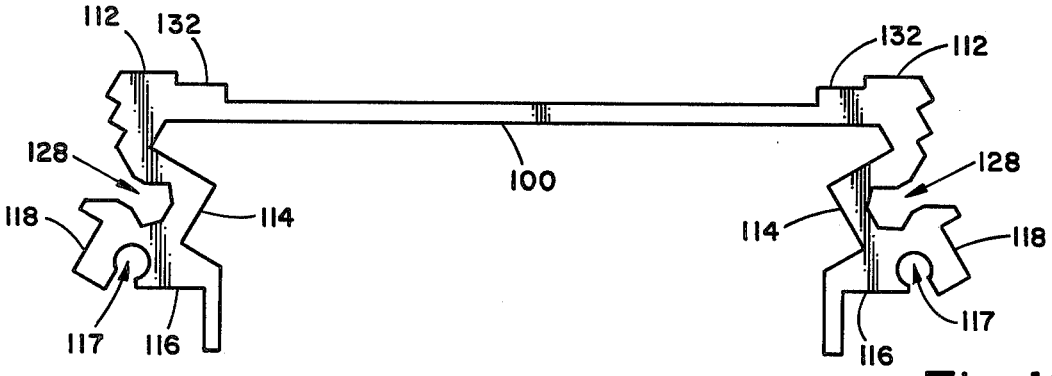
FIG. 12 is a cross-sectional view of the main type of support beam used in construction of the medical column.
Figure 13:
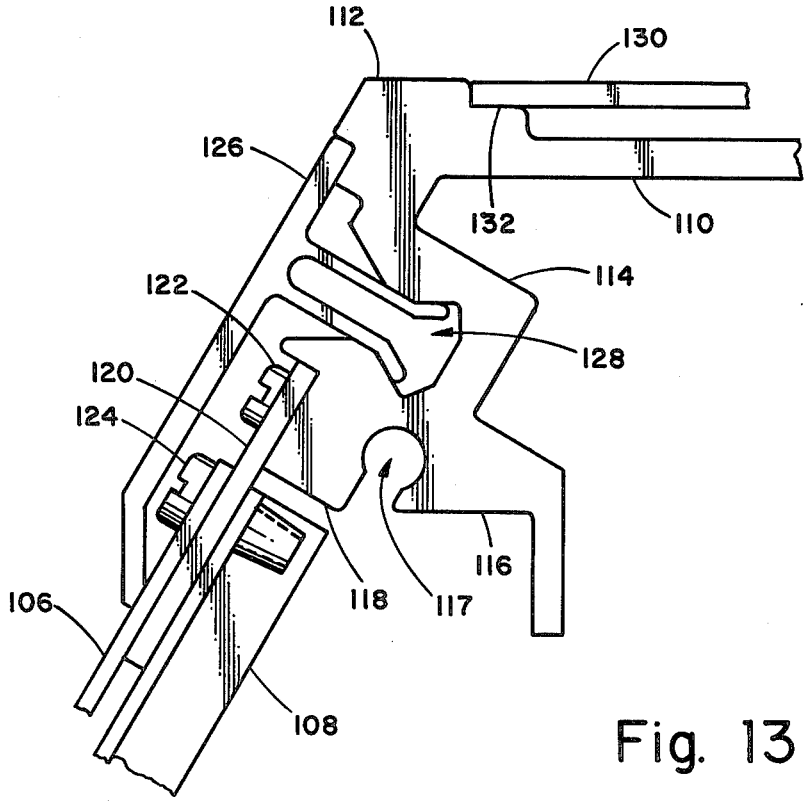
FIG. 13 is a cross-sectional view detailing the attachment of various components to the support beam.

As shown in FIG. 9 the lower wall enclosure 50 and the upper wall enclosure 70 have identical construction and comprise three support beams 100 having upper and lower ends. Three face panels 106 are attached between the support beams 100 to form the flat-cornered triangular shape and support rails 108 are attached to the support beams 100 and located directly behind the face panels 106 for supporting electrical and gas outlet boxes and other equipment. The support rails 108 form a typical construction of two angle iron sections or channels between which an electrical box, for example, can be attached at the top and the bottom of the electrical box. FIG. 12 shows a cross-section of the support beams 100. The support beam 100 comprises a flat body section 110 to which is attached a corner portion 112. A trim strip holding section 114 is attached to the other side of the corner portion 112. Attached to the trim strip holding section 114 is a support beam attachment section 116 and a face panel attachment section 118. The support beams 100 used in the lower wall enclosure 50 are attached to the base 36 by inserting a screw through holes 96 in the base 36 and into the hole like opening 117 of the support beam attachment structure 116. In the preferred embodiment the support beams 100 are made from extruded aluminum pieces and the screws are self-tapping screws which thread the aluminum in the support beam attachment section 116. As shown more clearly in FIG. 13, a metal support strip 120 is first attached to the face panel attachment section 118 with screw 122. The face panel 106 and the support rails 108 are then attached to the support strip 120 with screw 124. A plastic trim strip 126 snaps into the opening 128 in the trim strip holding portion 114 and covers screws 122 and 124 thereby giving a smooth overall finish to the medical column. In the preferred embodiment a decorative panel 130 is positioned over the flat body 110 and is located in seats 132 near corner portion 112.

Figure 10A:
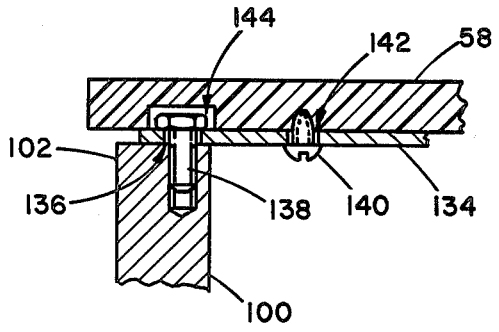
FIG. 10A is a cross-sectional view showing the attachment means for some of the components of the medical column.

As shown in FIG. 10A, the top cover 58 is attached to the upper end 102 of the support beam 100 by first attaching a section of sheet metal 134 of substantially the same configuration as the top cover 58, but smaller in size. The sheet metal 134 has holes 136 through which self-tapping screws 138 are inserted. Self-tapping screws are threaded into the hole like opening 117 of the support beam attachment section 116, thereby securing the sheet metal 134 to the top of the support beam 100. The top cover 58 is then attached to the sheet metal 134 by wood screw 140 which is inserted through opening 142 in the sheet metal 134. The top cover 58 has a recess 144 for accommodating the head of self-tapping screw 138. The bottom cover 64 and roof cover 80 for the upper wall enclosure are attached to support beams 100 in an identical manner.

Figure 11:
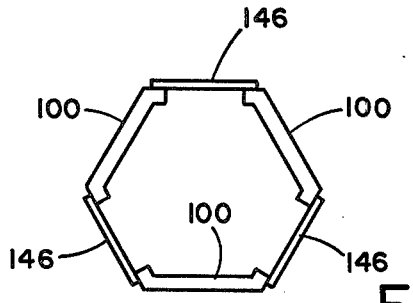

A similar construction is used for post 26 and is shown in FIG. 11. Post 26 comprises three support beams 100 and three trim panels 146 attached between the support beams 100 in a manner similar to that described above for the upper and lower wall enclosures. In the preferred embodiment three additional panels are attached over the flat bodies 110 of the support beams 100 so that the six-sided post 26 looks identical on each of its six sides. The post 26 is attached to the top cover 58 and to the bottom cover 64 in the same manner as the lower wall section 50 is attached to the base 36. Other means of attachment, as are well known in the art, may be utilized if additional strength is needed in attaching the posts 26 to the lower column section 12 and the upper column section 24. In the preferred embodiment all support beams 100 are formed from extruded aluminum and the face panels 106 and 146 are sheet metal with a finished surface. The base 36 also is sheet metal with a finished surface. In the preferred embodiment the face panels 106 of the upper wall enclosure 70 have light emitting portions 148 behind which fluorescent lights (not shown) are positioned. One, two or all three of the face panels 106 in the upper wall enclosure 70 may be used for room lighting. It has been found that two or three lights in the upper wall enclosure supply sufficient room lighting for a hospital room.

The top cover 58 and the bottom cover 64 in the preferred embodiment are formed from a laminated plastic sold under the trademark Formica. The roof cover 80 is fabricated from painted steel in the same manner as base 36.

Although the preferred embodiment is shown having the electric and gas sources 32 and 34 being in the ceiling 30 of the hospital room, the novel medical column can easily be adapted to have the provisions 78 and 79 for attaching the electrical and gas lines 60 and 62 in the base 36 for use when the sources 32 and 34 of electricity and gases are contained in the floor 28 of the hospital. An additional opening would then be provided in the base 36 for the electric and gas lines 60 and 62.

The novel medical column is designed so that medical and electrical devices and equipment may be placed wherever necessary for the multitude of applications for which the column may be used. FIGS. 3 through 6 of the novel medical column give one example of how equipment may be placed on the column. The lower wall enclosure 50 contains various electrical equipment such as transformers, circuit breakers, and line isolation monitors, as well as other electrical equipment. Located on the outer surface of the lower wall enclosure 50 are electrical receptacles 150, electrical switches 152, night lights 154, a telephone jack 156, electrical ground jacks 158, low voltage plugs 160 for relaying the signal output of medical equipment to remote locations, gas outlets 161, a nurse call intercom station 162, the controls 164 for a line isolation monitor, a row of circuit breakers 166 and a vacuum bottle tub 168. The post 26 has a task light 170 for aluminating the top cover 58, electrical switches 152, a low voltage receptacle 160, emergency buttons 172 and a bracket 174 for supporting a heart monitor. The upper wall enclosure has light emitting portions 148 in the face panels 106 for room lighting.

Numerous other features and options can be included with the medical column. For example, a digital clock-/timer read-out could be substituted for one of the light emitting portions 148 in the upper wall enclosure 70. Also, exam lights and direction lights could be attached to the flat-corners of the upper wall enclosure 70. Various other combinations of equipment and devices can be attached to the post 26 and the lower wall enclosure 50.

Figure 15:
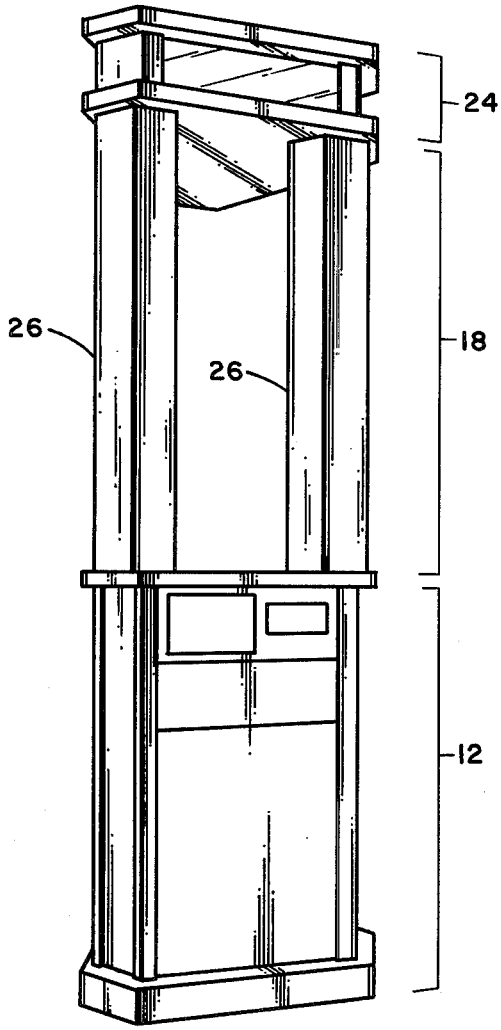
Figure 16:
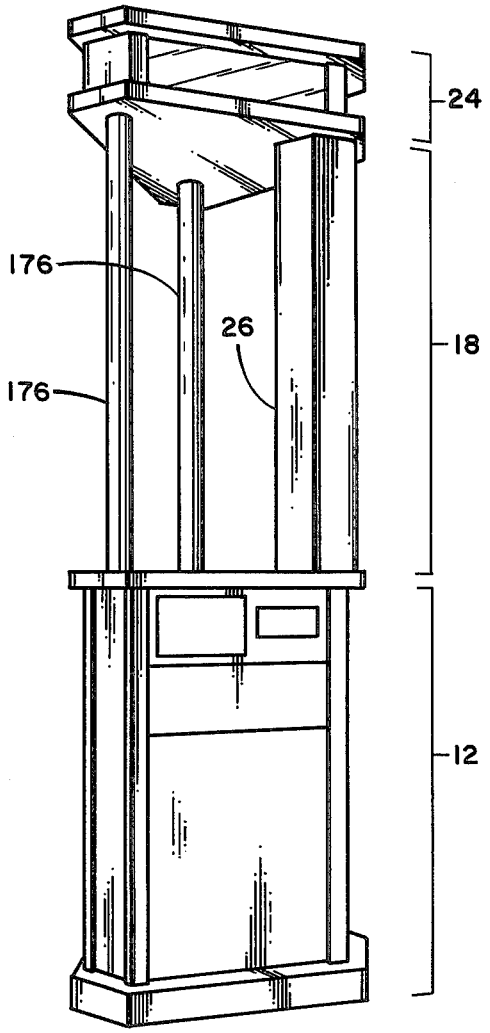

FIGS. 14, 15 and 16 illustrate alternative embodiments of the preferred invention. FIG. 14 shows an alternative embodiment which has no upper column section but rather post 26 of see-through section 18 extends substantially to the ceiling 30 of the room. FIG. 15 shows an embodiment which has two posts 26 incorporated into the medical column 10. FIG. 16 illustrates an alternative embodiment which has one post 26 and two rods 176 on the other two corners of the medical column 10. This embodiment would be used where it is necessary to support more weight in the upper column section 24. All of these embodiments may be secured to the floor of the hospital room or to the floor and ceiling of the hospital room. Likewise, they may receive their source of electricity and gases from the floor and/or ceiling of the hospital room.

The invention is not limited to the particular details of the apparatus depicted and other modifications and applications are contemplated. For example, the invention is not limited to the "flat-cornered triangular shape" disclosed but may have other cross-sectional configurations. Certain other changes may be made in the above described apparatus without departing from the true spirit and scope of the invention herein involved. It is intended therefore that the subject matter in the above depiction shall be interpreted as illustrative and not in a limiting sense.

We claim:

1. A medical power service column for use in a patient room having a floor and ceiling and sources of electricity and gases, said medical column supplying electrical power, lighting and gases and also providing a centralized support for medical equipment, said medical column comprising:

a base having a substantially triangular cross-sectional shape, said base having means for attaching said medical column to the floor of the patient room;

a vertically elongated lower column section having an upper end and a lower end for containing medical and electrical equipment and means for supporting medical and electrical equipment on its outer surface, said lower end of said lower column section being in contact with the base end said lower column section having a substantially triangular cross-sectional shape;

a see-through section comprising a vertically elongated post having a first end attached to said upper end of said lower column section and a second end extending upward toward the ceiling of the room; said post containing electrical and gas supply lines and having electrical outlets, switches, lights and means for holding medical equipment on the outer surface of said post;

an upper column section connected to the second end of the see-through section, said upper column section in substantial alignment with said lower column section and containing electrical and gas supply lines and provisions for attaching said electrical and gas supply lines of said medical column to sources of gas and electricity in the ceiling of the patient room; and means in said upper column section for attaching said medical column to the ceiling of the patients room such that said medical column is positionable adjacent a patient bed and wherein the substantially triangular shape of the lower column section allows free access to a patient in the bed while supporting medical equipment in close proximity thereto;

wherein said see-through section of said medical column provides a substantially unobscured view of the room.

2. The device described in claim 1, wherein said medical column extends completely between the floor and ceiling of the room.

3. The device described in claim 1, wherein said column for supporting medical and electrical equipment is positioned off-center with respect to said lower column section.

4. The device described in claim 1, wherein said lower column section is substantially greater in height than said upper column section.

5. The device described in claim 1, wherein said upper column section has lighting capability.

6. A medical power service column for use in a hospital room having a floor and ceiling and sources of electricity and gases, said medical column supplying electrical power, lighting and gases and also providing a centralized support for medical equipment, said medical column comprising:

a base having a flat-cornered triangular cross-section shape and also having means for attaching said base to the floor of the hospital room;

a lower wall enclosure having an upper end and a lower end attached to said base, and having a flat-cornered triangular cross-sectional shape in alignment with said base, said lower wall enclosure containing electrical and gas supply lines and electrical equipment and supporting electrical and gas outlets and means for holding medical equipment on its outer surface, said lower wall enclosure comprising;

three support beams having upper and lower ends located at each of the corners of said lower column segment, said lower ends of said support beams being attached to said base, three face panels attached between said support beams to form said flat-cornered triangular shape, and support rails attached to said support beams and located directly behind said face panels for supporting electrical and gas outlet boxes and other equipment; a top cover attached to said upper ends of said three support beams and covering the upper end of said lower wall enclosure, said top cover having a flat-cornered triangular shape and an aperture through which pass said electrical and gas supply lines;

a see-through section having a reduced dimension relative to said lower wall enclosure and extending upward from said top cover over said aperture in said top cover, said see-through section comprising a six-sided post having three support beams having upper and lower ends, the lower end of said support beams being attached to said top cover and also having three trim panels for connecting said three support beams to form said six-sided post, said post containing electrical and gas supply lines and having electrical outlets, switches, lights and means for holding medical equipment on the outer surface of said post;

a bottom cover having a flat-cornered triangular shape corresponding to said top cover and attached to the upper end of said three support beams of said see-through section, said bottom cover also having an aperture positioned over said post through which pass said electrical and gas supply lines;

an upper wall enclosure comprising three support beams having upper ends and having lower ends attached to said bottom cover and three face panels attached to said three support beams to form a flat-cornered triangular shape, said upper wall enclosure containing electrical and gas supply lines and having electrical devices and provisions for attaching said electrical and gas supply lines of said medical column to the sources of electricity and gas in the ceiling of the hospital room; and a roof cover in close proximity to the ceiling of the hospital room having a flat-cornered triangular shape corresponding to said bottom cover and attached to said upper ends of said three support beams of said upper wall enclosure, said room cover also having an aperture for receiving said sources of electricity and gases, said roof cover futher having means for attaching said medical column to the ceiling of the hospital room; and wherein said medical column is positioned such that one of the corners of said medical column is next to a patient's bed and wherein said flat-cornered triangular shape of said medical column allows free access to a patient in the hospital bed while supporting medical equipment in close proximity; and wherein said see-through section of said medical column provides a substantially unobscured view of the hospital room for personnel in the room.

7. The device described in claim 6, wherein said post is positioned near one of the corners of said medical column.

8. The device described in claim 6 wherein said lower wall enclosure is substantially greater in height than said upper wall enclosure.

9. The device described in claim 6, wherein at least one of said face panels of said upper wall enclosures has light emitting portions for providing room lighting for the hospital room, said upper wall enclosure also having electric lights located behind said light emitting portion for supplying said room lighting.

10. The device described in claim 6, wherein said electrical and gas lines extend into said base and said base has provisions for attaching said electrical and gas supply lines to the sources of electricity and gas in the floor of the hospital room.

11. A medical power service column for use in a hospital room having a floor and ceiling and sources of electricity and gases, said medical column supplying electrical power, lighting and gases and also providing a centralized support for medical equipment, said medical column comprising:

a base having a substantially triangular cross-sectional shape and also having means for attaching said base to the floor of the hospital room;

a lower wall enclosure having an upper end and a lower end attached to said base, and having a substantially triangular cross-sectional shape, said lower wall enclosure containing electrical and gas supply lines and electrical equipment and supporting electrical and gas outlets and means for holding medical equipment on its outer surface, said lower wall enclosure comprising;

three support beams having upper and lower ends located at each of the corners of said lower column segment, said lower ends of said support beams being attached to said base, three face panels attached between said support beams to form said substantially triangular shape, and support rails attached to said support beams and located directly behind said face panels for supporting electrical and gas outlet boxes and other equipment;

a top cover attached to said upper ends of said three support beams and covering the upper end of said lower wall enclosure, said top cover having a substantially triangular shape and an aperture through which pass said electrical and gas supply lines;

a see-through section having a reduced dimension relative to said lower wall enclosure and extending upward from said top cover over said aperture in said top cover, said see-through section comprising a post having upper and lower ends, said post containing electrical and gas supply lines and having electrical outlets, switches, lights and means for holding medical equipment on the outer surface of said post;

a bottom cover having a substantially triangular shape and attached to the upper end of said post, said bottom cover also having an aperture positioned over said post through which pass said electrical and gas supply lines;

an upper wall enclosure comprising three support beams having upper ends and having lower ends attached to said bottom cover and three face panels attached to said three support beams to form a substantially triangular shape, said upper wall enclosure containing electrical and gas supply lines and having electrical devices and provisions for attaching said electrical and gas supply lines of said medical column to sources of electricity and gas in the ceiling of the hospital room; and means for attaching said medical column to the ceiling of the hospital room;

wherein said medical column is positioned such that one of the corners of said medical column is next to a patient's bed and wherein said triangular shape of said medical column allows free access to a patient in the hospital bed while supporting medical equipment in close proximity; and wherein said see-through section of said medical column provides a substantially unobscured view of the hospital room for personnel in the room.

12. The device described in claim 11, wherein said medical column extends completely between the floor and ceiling of the hospital room.

13. The device described in claim 11, wherein said post for supporting medical and electrical equipment is positioned off-center with respect to said lower wall enclosure.

14. The device described in claim 11, wherein said lower wall enclosure is substantially greater in height than said upper wall enclosure.

15. The device described in claim 11, wherein said upper wall enclosure has lighting capability.

* * * * *